United States Patent [19]

Castro

[11] Patent Number: 4,788,005

[45] Date of Patent: Nov. 29, 1988

[54] THICKENED AQUEOUS ABRASIVE CLEANSER EXHIBITING NO SYNERESIS

[75] Inventor: James M. Castro, Dublin, Calif.

[73] Assignee: The Clorox Company, Oakland, Calif.

[21] Appl. No.: 50,838

[22] Filed: May 15, 1987

[51] Int. Cl.[4] ..... C11D 3/065

[52] U.S. Cl. ..... 252/539; 252/135; 252/174.14; 252/174.25; 252/173; 252/174.19; 252/89.1; 252/540; 252/DIG. 14

[58] Field of Search ..... 252/174.25, 140, 539, 252/174.14, 534, 535, 540, DIG. 14, DIG. 173

[56] References Cited

U.S. PATENT DOCUMENTS

| | | | |
|---|---|---|---|
| 3,042,622 | 4/1962 | Kirschenbauer | 252/99 |
| 3,149,078 | 9/1964 | Zmoda | 252/137 |
| 3,192,166 | 6/1965 | Smith | 252/137 |
| 3,281,367 | 10/1966 | Jones et al. | 252/112 |
| 3,449,254 | 6/1969 | Suiter | 252/99 |
| 4,181,633 | 1/1980 | Colodney et al. | 252/525 |
| 4,240,919 | 12/1980 | Chapman | 252/95 |
| 4,379,080 | 4/1983 | Murphy | 252/526 |
| 4,670,179 | 6/1987 | Inamorato et al. | 252/174 |

*Primary Examiner*—Paul Lieberman
*Assistant Examiner*—Helene Kirschner
*Attorney, Agent, or Firm*—Michael J. Mazza; Joel J. Hayashida; Stephen M. Westbrook

[57] ABSTRACT

A thickened hard surface abrasive cleanser is provided which may have high levels of silicates for superior cleaning, exhibits substantially no syneresis, and has a use-favorable rheology. The cleanser comprises, generally:

(a) an alkali-metal silicate/borate anion thickener
(b) an electrolyte/buffer
(c) an anionic surfactant; and
(d) a particulate abrasive.

The composition of the invention is attained only on following a defined formulation protocol. Accordingly, a method is provided which yields the inventive composition. The composition may be formulated to a viscosity of between about 10,000 and 250,000 cP, and a yield value of between about 1 and 80 Pa.

19 Claims, 3 Drawing Sheets

THICKENED AQUEOUS ABRASIVE CLEANSER EXHIBITING NO SYNERESIS

BACKGROUND OF THE INVENTION

1. Field of the Invention

This invention relates to thickened aqueous scouring cleansers containing abrasives and more particularly to such cleansers which are formulated to exhibit plastic rheologies and which exhibit substantially no syneresis.

2. Description of the Prior Art

In the guest for hard surface cleaners which have efficacy against a variety of soils and stains, various heavy duty abrasive-containing and/or thickened cleansers have been developed. As an example, U.S. Pat. Nos. 3,985,668, 4,005,027 and 4,051,056 all issued to Hartman, show a combination of perlite (an expanded silica abrasive, which is here used as a filler), a colloid-forming clay, in combination with a hypochlorite bleach, a surfactant and a buffer in which abrasives are suspended. A clay thickened system of this type tends to set up or harden upon storage due to the false body nature of the thickneners, and require shaking before use to break down the false body structure. Beyer, U.S. Pat. No. 4,235,732 also describes a bleaching cleanser, including a clay suspending agent to result in a false-bodied fluid. Other prior art cleaners which attempt to suspend abrasives use either inorganic colloid thickeners only or mixed surfactant thickeners at high levels of surfactants. Additionally, syneresis becomes a problem as the solids portion of such cleansers substantially separate from the liquids portion. One approach to alleviate this is to use a perlite type material with specified particle size as defined in Hartman. High levels of surfactants can be used to form a rheology favorable for the suspension of abrasives. These mixed surfactant thickened compositions, shown for example, in U.S. Pat. Nos. 4,352,678, and 4,588,514 issued to Jones et al, have been used to suspend abrasives and to incorporate a source of hypochlorite bleach. However, Jones et al require large amounts of expensive surfactants in order to suspend abrasives, and do not provide a particularly use favorable rheology.

U.S. Pat. No. 4,287,079, issued to Robinson, relates to a clay/silicon dioxide thickened, bleach-containing abrasive cleanser which could contain an anionic surfactant. Due to the clay-thickened rheology, cleansers of this sort quickly dry out and set up. These types of cleansers become less flowable over time, and are also plagued by significant syneresis problems. U.S. Pat. No. 3,956,158, (also British Pat. No. 1,418,671) issued to Donaldson shows an abrasive-containing bleach thickened with insoluble detergent filaments. It has been surprisingly found that calcium carbonate ($CaCO_3$), used as an abrasive in many prior art formulations, greatly accelerates the syneresis process in compositions having alkali-metal silicates and bicarbonates.

Other patent references disclose or suggest the use of borax, borate or perborate as an electrolyte or buffer in an abrasive cleanser. These include U.S. Pat. Nos. 4,599,186, and 4,657,962 issued to Choy et al, which describe an alumina-thickened cleanser without substantial syneresis and including SAS and LAS surfactants, sodium silicates and calcite. U.S. Pat. No. 3,850,833 issued to Koceich et al, comprises a calcium carbonate abrasive, LAS and alkane sulfonate surfactants, sodium silicates and borax. Bechtold U.S. Pat. No. 3,860,525 includes ethoxylated alcohol surfactants, sodium silicates and borax. Moore, U.S. Pat. No. 3,530,071 includes a calcium carbonate abrasive, LAS surfactant, sodium silicate and borax as a stabilizer for a chlorinated TSP bleach. Puryear, U.S. Pat. No. 4,248,728 describes an abrasive hard surface cleanser thicknened with a colloidal magnesium aluminum silicate clay to result in a thixotropic rheology. Puryear also includes sodium metasilicate, a hypochlorite bleach, a calcium carbonate abrasive and may include LAS, SAS and ethoxylated alcohol surfactants, bicarbonates and borates. Puryear, however operates in a relatively high pH range (11–14) and the magnesium aluminum silicate requires heating, or the application of high shear, during production to achieve the rheology. U.S. Pat. No. 3,444,254 issued to Suiter describes a borax/sodium-silicate stabilizer for a peroxide bleach.

In view of the art there is a need for a thickened hard surface cleanser which is capable of suspending abrasives, exhibits no syneresis over time, does not require shaking before use and has superior cleaning performance.

It is therefore an object of the present invention to provide a thickened abrasive cleanser with a plastic flowable rheology, which does not have a tendency to set up or harden and exhibits substantially no syneresis.

It is another object of the present invention to provide a thickened cleanser which can stably suspend abrasives.

It is another object of the present invention to provide a thickened hard surface cleanser with demonstrated cleaning efficacy on oil and grease stains, soap scums, mildew and particulate soils.

It is yet another object of the present invention to provide a cleanser with sufficient viscosity and yield value to adhere to non-horizontal surfaces.

SUMMARY OF THE INVENTION

One embodiment of the invention is a hard surface abrasive scouring cleanser without substantial syneresis comprising, in aqueous solution:

(a) an alkali-metal silicate/borate anion thickener;
(b) an electrolyte/buffer;
(c) an anionic surfactant; and
(d) a particulate abrasive.

The hard surface abrasive scouring cleanser of the present invention provides excellent abrasive-suspending stability, and also exhibits a favorable plastic type rheology. Additionally, the cleanser of the present invention shows substantially no syneresis. These syneresis values are also stable over time and at elevated temperatures. Because of the resulting physical stability, the cleanser does not require shaking before use to resuspend solids into a flowable form.

A further embodiment of the invention provides an aqueous hard surface abrasive cleanser without substantial syneresis comprising, in aqueous solution:

(a) a sodium silicate/borax thickener;
(b) a mixed surfactant system which comprises at least one anionic surfactant and one nonionic surfactant;
(c) an electrolyte/buffer;
(d) a calcium carbonate abrasive.

Also provided is a method for making the cleansers of the present invention. When made as described herein, the cleansers of the present invention display the favorable rheology over a viscosity range of between about 10,000 to 250,000 centipoise (cP), and a yield value of between about 1 and 80 Pascals (Pa).

It is therefore an advantage of the present invention than an aqueous hard surface abrasive scouring cleanser is provided which has the ability to stably suspend abrasive particles.

It is a further advantage of the present invention that the hard surface abrasive scouring cleanser has substantially no syneresis, and is stable over time and at elevated temperatures.

It is yet another advantage of the present invention that an aqueous hard surface abrasive cleanser is provided which does not require shaking before use to resuspend abrasives and other solids.

It is another advantage of the present invention that the thickened cleaners has sufficient viscosity and yield value to adhere to non-horizontal surfaces.

It is still another advantage of the present invention that the aqueous hard surface abrasive cleanser does not set up or harden over time and therefore remains easily flowable.

It is yet another advantage of the present invention that the composition can be manufactured without the need for a heating step.

It is a further advantage of the present invention that the aqueous scouring abrasive cleanser has demonstrated cleaning efficacy on soap scums, greasy and oily soils, and particulate soils.

IN THE DRAWINGS

DETAILED DESCRIPTION OF THE PREFERRED EMBODIMENTS

The invention provides an efficacious hard surface abrasive scouring cleanser which has no significant syneresis, stably suspends abrasives, and has a use-favorable plastic rheology, which resists setting-up, dispenses easily and is sufficiently viscous to adhere to non-horizontal surfaces. All of the foregoing advantages are present even after these compositions have been tested over time and subjected to elevated temperatures. Of primary importance to the rheology of the present invention is the alkali-metal silicate/borate anion thickening system. Each of the individual constituents of this invention are described in more detail as follows. Unless stated otherwise, all composition percentages are weight percent of actives, with the balance of all formulations being water.

ALKALI-METAL SILICATE

One component of the thickening system of the present invention is an alkali-metal silicate, specifically one having the formula: $M_2O(SiO_2)_n$ where M represents an alkali-metal, and n is between about 0.5 and 5. As used hereinafter, the term "silicate" will be taken to mean these alkali-metal silicates. Preferred alkali-metal silicates are sodium, potassium and lithium silicates, with sodium silicate being the most preferred, and with a preferred n value of 2.4. Specific examples of the most preferred silicates include sodium orthosilicate and sodium metasilicate. Mixtures of any of the foregoing alkali-metal silicates are also suitable. The alkali-metal silicate is present in an amount of from about 2% to 10%, preferably about 3% to about 5%. A minimum of about 2% silicate is necessary to provide sufficient yield value to suspend the abrasive. A preferred commercially available sodium silicate is sold by the PQ Corporation under the Trademark RU, as a 47% solution. Sodium silicates are known in the art to be very effective at cleaning, especially when used on oil and grease stains. High levels of silicate, however can make the composition exceedingly viscous, and with a high yield value resulting in a composition which is difficult to dispense. It has been surprisingly found that relatively high levels of alkali-metal silicate can be included in the compositions of the present invention, and aid in cleaning performance without detriment to the desired rheology. The addition of borax has been found to unexpectedly mitigate the unfavorable rheological effect of high levels of silicate.

BORATE ANION

Figure 1B:
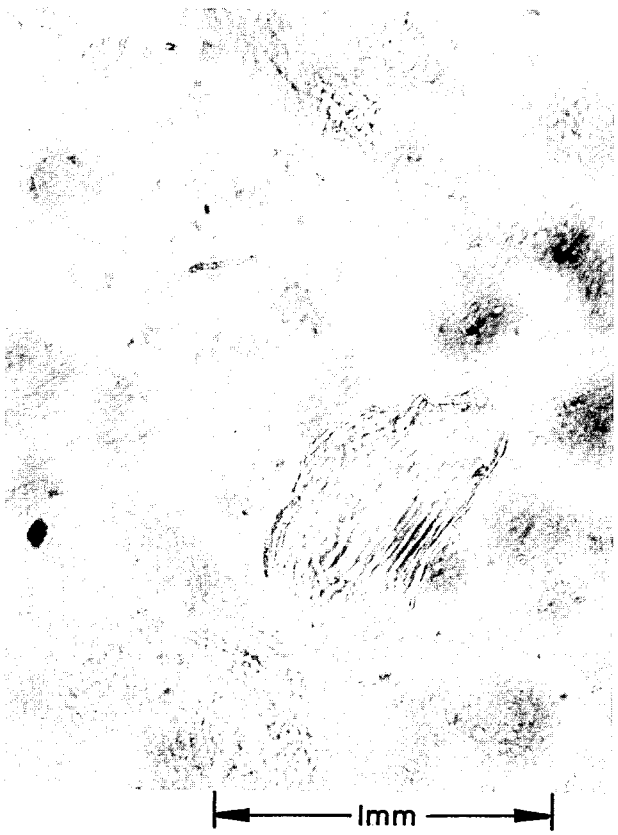
FIG. 1B. (PRIOR ART)
FIGS. 1A–1B are photomicrographs of a prior art cleanser showing a large colloidal sodium silicate structure, with FIG. 1A being illuminated from the top and FIG. 1B being illuminated from the top and bottom.
Figure 1A:
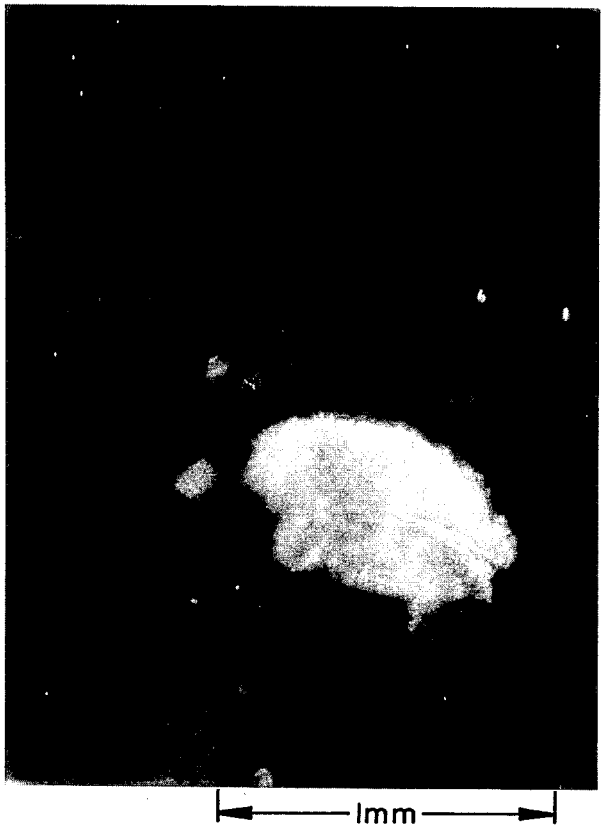
FIG. 1A. (PRIOR ART)
Figure 2B:
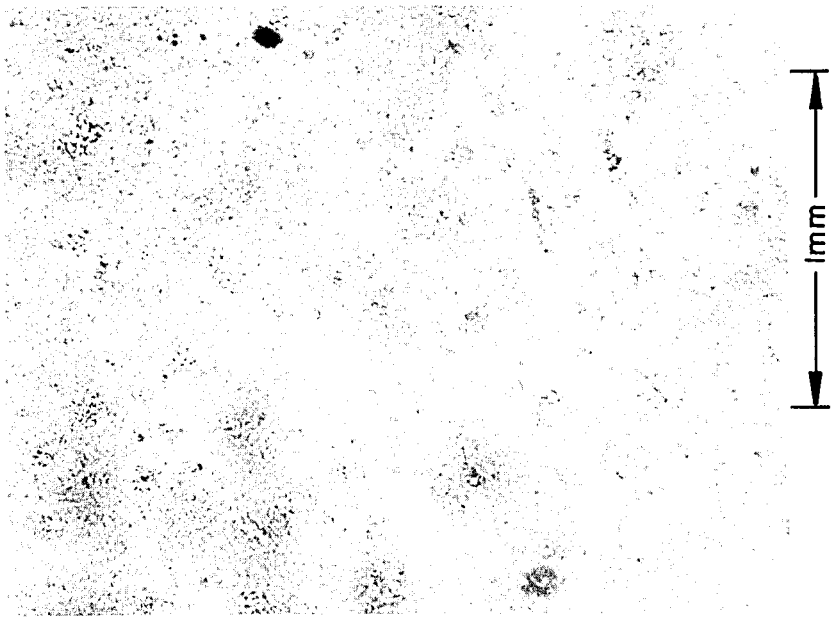
FIGS. 2A–2B are photomicrographs of a cleanser of the present invention, with FIG. 2A being illuminated from the top and FIG. 2B being illuminated from the top and bottom.
Figure 2A:
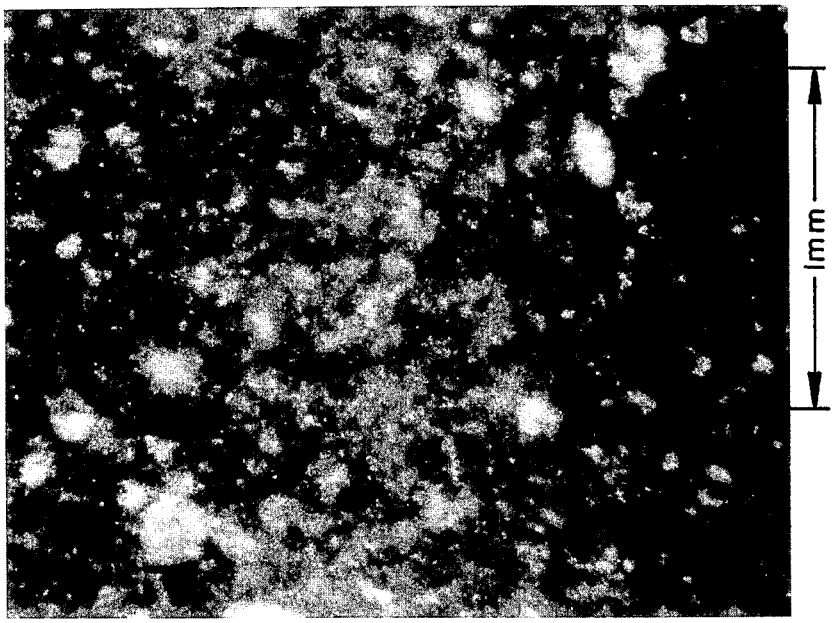

The other component of the thickening system of the present invention is a source of borate anion. Preferred sources of borate anion include borax (sodium tetraborate), sodium metaborate and boric acid (the latter two may require greater amounts of electrolyte/buffer to provide the preferred pH range). Most preferred is borax. Degree of hydration, or lack thereof, of the borax is unimportant, as in the aqueous solution the borax will become fully hydrated or dissolved. The borax is present in an amount of between about 1 and 15% by weight of active, more preferred is about 5–10%. Also important is a ratio of borate anion to silicate. Preferred is a ratio of about 1:5 to 4:1 to the silicate. Without intending to be bound by a particular theory, it is believed that the borate anion modifies the $SiO_4$ tetrahedra of the silicate network in the cleanser formulation. It is known in the art that silicates form networks through oxygens present in the crystalline structure. It is also known that borates are known for their cross-linking effects. Contrary to the expectation, based on the art, that borates would increase the cross-linking, hence the viscosity of the composition, it has been surprisingly found that viscosity is not significantly increased, but the composition rheology is improved in that syneresis is greatly reduced, and the composition exhibits a plastic, flowable rheology. FIGS. 1A–1B are photomicrographs, taken at 40X, of a prior art silicate structure with no added borax. It can be seen that large colloidal structures are present. FIGS. 2A–2B are photomicrographs, at the same magnification of the composition of the present invention. No large structures are present in the composition of the present invention. FIGS. 1A–B and 2A–B were taken by placing one drop (about 50 mg) of the respective compositions on a clear glass slide, and placing a cover plate thereover. A Bausch and Lomb BALPLAN model microscope and Polaroid 667 film were used to obtain the photographs. It is believed that instead of simply cross-linking the silicates to produce large structures, as would be expected by the teachings of the art, the borate modifies the silicate structure by borate insertion or deflocculation to result in finer colloidal structures. These are apparently sufficient to result in the desired thickening and abrasive suspension, but do not result in composition separation.

In addition to the unexpected rheology resulting from the silicate/borate thickening system borax surprisingly stabilizes the composition against syneresis, hardening and setting-up. It has been discovered that the calcium carbonate abrasive greatly accelerates syneresis. Table 1 shows syneresis values for compositions with and without calcium carbonate. Table 2 shows the syneresis values for compositions including calcium carbonate and borax. The composition lifetimes of Table 2 were obtained under storage conditions including a very low temperature which tends to promote syneresis. The $CaCO_3$-containing composition of Table 1 included actives in the following ranges: 1.0% LAS, 2.6% SAS, 2.4% nonionic surfactant, 3.0% bicarbonate, 6.5% borax, 3.0% silicate and 0.5% fragrance. The non-carbonate composition of Table 1 contained the same amounts of actives, but the percentage of each was increased by about 43% owing to the removal of the $CaCO_3$. Table 2 compositions included 30% calcium carbonate, 2.8% LAS, 2.6% SAS, 2.8% nonionic surfactant, 0.2 fragrance and percent bicarbonate equal to percent silicate. Generally, thickening of solutions is achieved by solid-solid interactions, which however, also lead to instability as the solids tend to clump together and precipitate. It is thought that a borosilicate structure is formed which is a finely divided, probably hydrated, solid. The particles are probably connected to each other and/or to the liquid phase by hydrogen bonding. It is believed that the borosilicate structure has enough of a solid-liquid component to reverse some of the solid-solid interactions and substantially eliminate syneresis and setting-up.

TABLE 1

| % Calcium Carbonate | Lifetime at 70° F. (weeks) |
|---|---|
| 0 | 12 |
| 30 | 1 |

TABLE 2

| | Lifetime at 35° F. (weeks)* % Borax | | |
|---|---|---|---|
| % Silicate | 3.0 | 6.5 | 10.0 |
| 3.0 | 1 | — | 27 |
| 3.5 | — | 27 | — |
| 4.0 | 27 | — | 27 |

*observation ceased after 27 weeks

SURFACTANTS

As mentioned above, the surfactants suitable for use in this invention are selected from anionic and nonionic surfactants, and mixtures thereof. While the derived rheological properties of the present invention are attained by the use of a single anionic surfactant, it is especially preferred to use a combination of two anionics and a nonionic in order to maximize the formulation's cleaning effectiveness. The surfactants added for cleaning effective purposes are hereinafter termed "cosurfactants". The anionic surfactants are selected from surfactants such as alkali metal alkyl sulfates, primary and secondary alkane sulfonates, linear alkyl benzene sulfonates, alkyl ether sulfates, and mixtures thereof. These anionic surfactants will preferably have alkyl chain groups averaging about 8 to 18 carbon atoms. The preferred anionic surfactant is a LAS having an alkyl group averaging 8 to 18 carbons. Most preferred is a LAS with an alkyl group averaging 10 to 14 carbons. Commercial sources of such surfactants are the Pilot Chemical Company and the Vista Chemical Company. A preferred anionic cosurfactant, principally for its cleaning effectiveness, is a secondary alkane sulfonate. An example of a particularly preferred secondary alkane sulfonate is HOSTAPUR SAS, a trademarked product manufactured by Farbwerke Hoechst A. G. Preferred nonionic cosurfactants include the ethoxylated alcohols, especially those having an average chain length of about 6–20 carbons, and having about 4–9 moles of ethylene oxide per mole of alcohol. A most preferred example of such a surfactant is an ethoxylated alcohol having a 9 carbon average chain length and 6 moles of ethylene oxide per mole of alcohol. A commercially available example thereof is a product sold by the Union Carbide Corporation under the trademark TERGITOL TMN-6. Other examples include Shell Chemical Company's trademarked NEODOL series, and Texaco's SURFONIC series and Vista Chemical Company's ALFONIC. Also suitable are the ethoxylated alkyl phenols, especially Rohm and Haas' trademarked TRITON series.

Low levels of certain amphoteric/zwitterionic surfactants, principally amine oxides and betaines, may aid thickening to some extent. Generally, no more than about 1% of such surfactants may be added without altering the rheology. The anionic surfactant is present in the composition from about 0.5% to about 5%. Cosurfactants may be present in an amount from about 0 to 10% total. Most preferably about 2 to 3% of the LAS is present with a like amount of each of the SAS and ethoxylated alcohol surfactants.

Appropriate ratios of silicates to borax and LAS surfactant to thickener are important to the invention. Amounts of thickener (silicates plus borax) are based on the desired viscosity and yield values. The silicates also must be present in a minimum cleaning-effective amount and the borax in a minimum syneresis-mitigating amount. In practice, the thickener is present from about 3 to 25% by weight of the composition. The amount of each active added is dictated by the type of product performance desired, i.e., thickening, cleaning, lack of or substantially no syneresis and abrasive suspending. It has been found that preferably about 0.5% to 15% of total surfactant is used in the cleansers of the invention, of which 0.5% is the LAS. A preferred ratio of LAS to total thickener (silicate plus borax) is about 1:10 to 1:1. These ranges appear to result in compositions having the desired rheology/syneresis values, and ability to suspend abrasives. Less than this tends to increase syneresis values, although acceptable products may still occur at lower levels and are still considered part of this invention. Total levels below this range may not successfully suspend abrasives and may lessen overall performance attributes of the cleansers, although such lower levels are still within the scope of the invention.

ELECTROLYTE/BUFFER

The electrolyte/buffer appears to promote the favorable environment in which the silicate and borax can combine, and interact with the surfactant. The preferred electrolyte/buffers are generally the alkali metal salts of various inorganic acids, including alkali metal salts of carbonates, bicarbonates, hydroxides, and mixtures of the same. Certain divalent alkaline earth salts, e.g., alkaline earth salts of, carbonates, hydroxides, etc., can function singly as buffers. If such compounds are used, they may be combined with at least one of the previous electrolytes/buffers mentioned to provide the appropriate pH adjustment. It may also be suitable to use as buffers such materials as aluminates and organic materials, such as gluconates, succinates, maleates, and their alkali metal salts. It is very important to the practice of the invention that the electrolyte/buffer maintains the pH range within a critical range or the desirable rheology will not be attained. Preferably the pH should be between about 9.0 to 11.5, more preferably about 9.2 to 11.2, most preferably about 9.7 to 10.7. Sodium bicarbonate is the preferred buffer as the $pK_2$ of carbonic acid is about 10.2. Additionally the sodium bicarbonate does not interact adversely with any other ingredients, and is very cost effective. It is noted that the silicates and the borax used to provide the favorable rheology of the present invention can also act individually as the electrolyte/buffer to keep the pH range of the inventive cleansers within the desired limits. The amount of electrolyte/buffer added solely for purposes of buffering can vary from about 0% to 10%. Preferably where sodium bicarbonate is the sole added buffer, it is added at levels equal to or slightly less than the level of silicate.

ABRASIVE

A calcium carbonate ($CaCO_3$) abrasive, e.g. Calcite, is the abrasive of choice for the present invention. Calcite is classified as a soft abrasive, and has a Moh's hardness of less than about four. Such a soft abrasive is preferred from a commercial viewpoint, but other abrasives may be substituted for some of, or added along with, the Calcite, without detriment to the rheology of the present invention. Examples of various adjunct abrasives include alumina, silica, perlite, quartz, pumice, feldspar, talc and zeolites.

A particle size range of commercially available Calcite should be such that 99% passes through a U.S. 40 mesh screen. More preferred is 99% through a U.S. 60 mesh screen. Most preferred is 99% through a U.S. 100 mesh screen, but not so fine as to significantly affect the rheology of the composition. The abrasive can be present in the composition from a minimum amount needed to result in a cleaning benefit, (about 10%) to a level of about 50%. Beyond this, the abrasive tends to impair the rheology of the invention. Most preferred is about 25–35% calcium carbonate.

OPTIONAL COMPONENTS

To improve the commercial viability of the composition, various optional ingredients may be incorporated in the formulation. For example, fragrances, such as those commercially available from IFF, may be included at levels of 0 to 1%. Colors and dyes, including titanium dioxide and ultramarine blue may improve aesthetics of the composition. Enzymes are often stabilized by high calcium levels and would accordingly, operate well in the present composition. Fluorescent whitening agents and polishes (including waxes and acrylics), and solvents such as alcohols and terpenes are also compatible with the formulation of the present invention. Additional ingredients, such as bleaches, which are stable in the pH range of the composition, may be added at low levels.

Critical to the success of the invention is the method of making the composition. It is desired to achieve a composition viscosity of between about 10,000 and 250,000 cPs,. more preferably between about 30,000 and 100,000 cPs, most preferably between about 50,000–70,000 cPs. A minimum yield value needed to suspend abrasives is about 1 pA; a preferred yield value is about 1–80 Pa, more preferred is about 10–40 Pa. Viscosity values given herein, unless otherwise stated are measured at 0.5 rpm with a rotating spindle (e.g., Brookfield) viscometer. Yield values are determined, unless otherwise stated, by measuring viscosities at 0.5 and at 1.0 rpm. It is recognized that such low shear measurements on compositions exhibiting yield values may be somewhat inaccurate, thus the ranges are empirical and intended to be illustrative, not limiting. While, owing to the plastic rheology of the invention, the yield value eed not be high, some yield value is necessary to suspend the abrasives. A first step in the method is to prepare a slurry of the abrasive, borate-anion and water. This mixture is stirred in a cylindrical vessel for about 1–3 minutes, and then the surfactants are added, followed by any optional ingredients, the silicate and electrolyte/buffer are added last. The resulting mixture is stirred for about 30–60 minutes, or until completely mixed as evidenced by a uniform appearance. Mixer speed should be controlled to give vigorous mixing without a vortex, which would draw in air and cause excess foaming. Typically mixing is done with a multiple blade impeller, witn the pitch and blade radius dictated by known efficiency considerations. No inputs of heat or pressure are necessary to make the cleanser of the present invention; mixing takes place under ambient conditions, and any temperature increase in the composition is an incidental effect of the applied shear.

Figure 3:
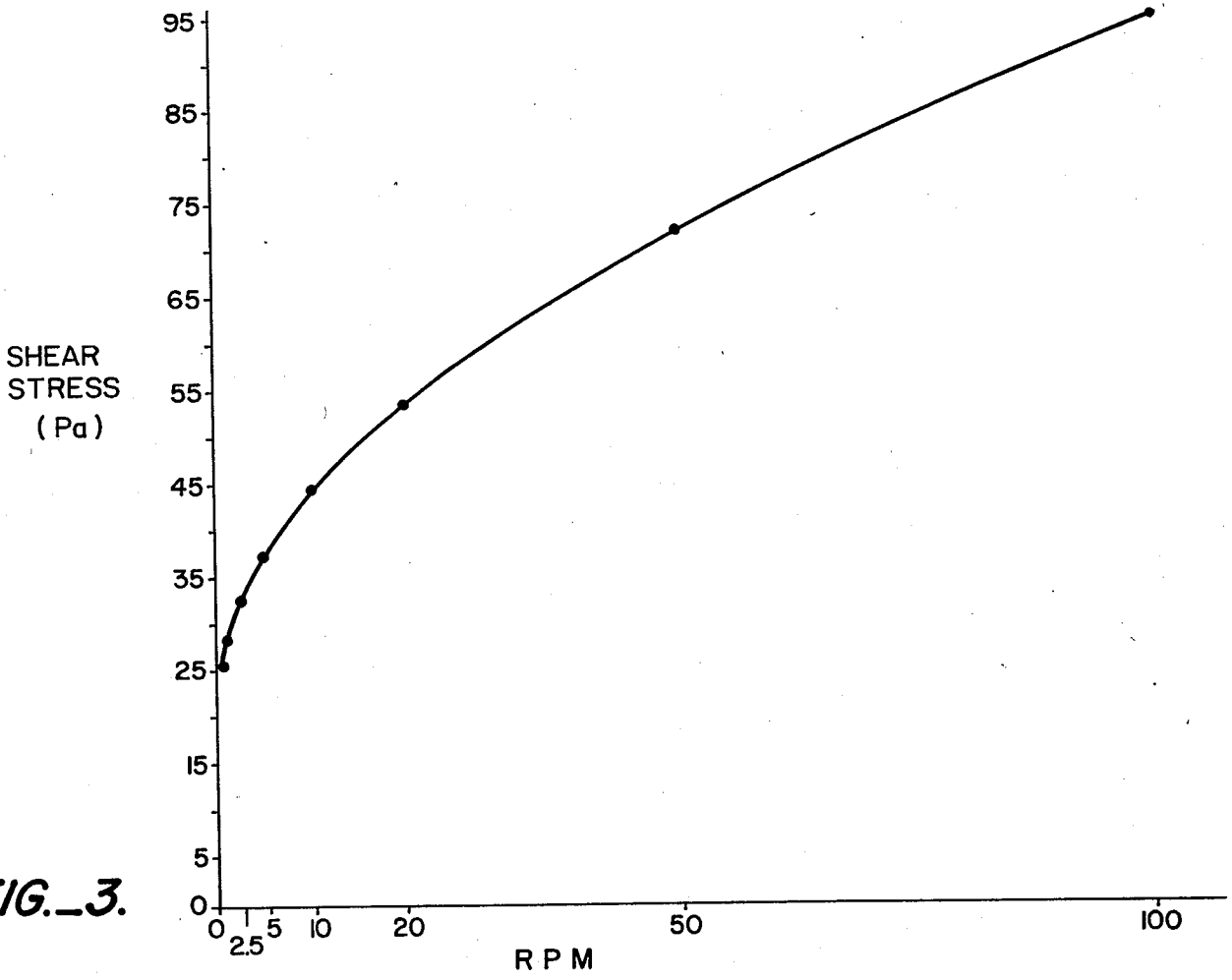
FIG. 3 is a rheogram, taken with a Brookfield viscometer and a number 3 spindle, of a preferred composition of the cleanser of the present invention and showing the plastic rheology thereof.

The rheology of the cleanser of the present invention, as illustrated by FIG. 3, may be characterized as non-thixotropic, and has attributes of a plastic rheology with a yield value. The graph of FIG. 3 shows shear rate (as spindle rpm) vs shear stress (in Pa). Only a single curve is shown as the up and down curves of FIG. 3 are essentially identical within the experimental limitations of the viscometer. Thus, the composition is viscoelastic under stress, (e.g., while being forced through a dispensing orifice) and becomes flowable after the yield value is reached. After the stress is removed, however, the fluid returns to its original state. The yield value of the composition may be adjusted to be within a range of about 1 to about 80 Pa within the viscosity range of the composition. While a minimum yield value is necessary in order to stably suspend abrasives, too high a yield value will render the cleanser difficult to dispense and use. It is desirable to maintain the viscosity in the indicated range to provide efficacy on non-horizontal surfaces by a long residence time, and to aid in concentrating actives on the most heavily soiled portions of the surface. Thus, the composition of the present invention, provides the recognized viscosity benefits while keeping the yield value low for easy dispensing. Additionally, the composition is not shear thinning to a significant degree. This aids in maintenance of the previously-mentioned viscosity benefits, as well as consumer preference, as the composition minimizes thinning during scouring.

The following nonlimiting examples are provided by way of illustration only.

EXAMPLE 1

A slurry of 74 kg of calcium carbonate (as −100 mesh Calcite) 16 kg of borax, and 85 kg water was prepared. This was stirred in a 200 L cylindrical vessel using a multiple pitch-blade impeller, for 1–3 minutes at about 100–400 rpm. Sufficient LAS surfactant was added to result in 2.5 weight percent of the composition, followed by a SAS surfactant to 2.6 weight percent, a fragrance to 0.4 weight percent and an ethoxylated alcohol surfactant to 2.5 weight percent. Sodium silicate was added to make 3.5 weight percent of the composition and equal amount of sodium bicarbonate was added. The mixture was stirred for about 45 minutes. The resulting composition exhibited a viscosity of about 60,000 cP (Brookfield viscometer using a number 2 spindle at 0.5 rpm) and a yield value around 25 Pa.

EXPERIMENTAL

I. Effect of % Borax on Yield Value

Table 3 shows yield values, initially and after storage at 70° F. for one week, of the composition with the indicated levels of borax. The compositions included 2.8% LAS, 2.8% nonionic surfactant, 0.2% fragrance, 4.0% each bicarbonate and silicate, and were otherwise made as in Example 1.

TABLE 3

| | % Borax | | | |
|---|---|---|---|---|
| Yield Value (Pa) | 0 | 1 | 2 | 3 |
| Initial | 148 | 90 | 95 | 93 |
| 1 week @ 70° F. | 92 | 59 | 60 | 60 |

II. Effect of Sodium Silicate and Borax and Sodium Bicarbonate on Yield Values

Tables 4, 5 and 6 show yield values as a function of sodium silicate and borax (varied within each table) and as a function of sodium bicarbonate (varied between tables). All examples were made using the procedure of Example 1, and include 2.5% LAS, 2.6% SAS, 2.5% ethoxylated alcohol, 0.4% of a fragrance and 30% $CaCO_3$.

TABLE 4

| 1% Sodium Bicarbonate | | | | |
|---|---|---|---|---|
| | | % Borax | | |
| | | 0 | 5 | 10 |
| % Sodium Silicate | 1 | 8 | 4 | 8 |
| | 3 | 1 | 23 | 16 |
| | 5 | 1 | 39 | 65 |

TABLE 5

| 3% Sodium Bicarbonate | | | | |
|---|---|---|---|---|
| | | % Borax | | |
| | | 0 | 5 | 10 |
| % Sodium Silicate | 1 | 21 | 12 | 16 |
| | 3 | 31 | 23 | 48 |
| | 5 | 74 | 49 | 73 |

TABLE 6

| 5% Sodium Bicarbonate | | | | |
|---|---|---|---|---|
| | | % Borax | | |
| | | 0 | 5 | 14 |
| % Sodium Silicate | 1 | 28 | 24 | 30 |
| | 3 | 62 | 27 | 43 |

TABLE 6-continued

| 5% Sodium Bicarbonate | | | | |
|---|---|---|---|---|
| | | % Borax | | |
| | | 0 | 5 | 14 |
| | 5 | 81 | 41 | 40 |

The data of Tables 4, 5 and 6 can be described by a regression equation (Equation I), which can account for 85.3% of the total variance. In Equation I, $X_1$=(% bicarbonate−3)/2, $X_2$=(% silicate−3)/2, $X_3$=(% borax−5)/5, and Y=yield value, in Pascals (Pa).

Equation I:

$$Y=[326+116X_1+174X_2-87.3X_1^2-112X_1X_3+-90.3X_3^2-134X_1X_2X_3]/10$$

This equation defines, within the above stated variance limit, the interrelationship of the borax, silicate and bicarbonate, within the percentage ranges of Tables 4–6, which can result in the composition of the present invention, and at a yield value range of about 1 to 80 Pa. It is to be noted that Equation I is intended only to generally define the composition relationships, not to explain them. Further the percentage ranges given in Tables 4–6 are generally centered around the midpoints of the preferred embodiments for convenience of definition. The inventive composition will still result, however from various combinations of individual ingredient percentages identified elsewhere herein, even though they may not fall within the scope of Equation I.

Without intending to be bound by a particular theory, various hypotheses may be advanced to account for, or interpret Equation I. Borax by itself has not significant effect on yield value, but bicarbonate and silicate together tend to increase yield value. Bicarbonate and borax show a negative interaction, i.e., borax lessens the tendency of bicarbonate to increase yield value. Borax alone displays a positive curvature, i.e., the yield value for medium levels of borax (around 5%) is less than that for high or low levels. At a mid-point of the most preferred percentage range (about 3% bicarbonate, 3% silicate and 5% borax) the yield value is 23 Pa.

PERFORMANCE

IV. Effect of Borax and Silicate Content on Cleaning Performance

Table 7 illustrates the cleaning effectiveness of the present composition on polymerized oil and grease, and on particulate soil. Testing was done with a Gardner wear tester, using a 1 kg weight. A 2.7 g amount of each cleanser was applied to a cellulose sponge along with 35 g of water (100 ppm hardness as $CaCO_3$, 70° F.). The number of strokes required to remove the stain, as determined visually, was recorded for each cleanser. Values given in Table 7 represent a rate of stain removal compared to a commercially available cleanser (as control) which was assigned a value of 1.0. Thus, the higher numbers indicate better stain removal. Formulations B and C contained 3.5% sodium silicate, while A had 3.0% sodium silicate. All included 30% $CaCO_3$ abrasive and percent bicarbonate equal to percent sodium silicate.

TABLE 7

| Formulation | Polymerized Oil and Grease | Particulate Soil |
|---|---|---|
| Control | 1.0 | 1.0 |

TABLE 7-continued

| Formulation | Polymerized Oil and Grease | Particulate Soil |
|---|---|---|
| A | .91 | .87 |
| B | 1.20 | 1.82 |
| C | 1.43 | 1.32 |

A = 0% borax, 1.0% LAS, 2.6% SAS, 1.0% ethyoxylated alcohol, 0.5% fragrance
B = 6.5% borax, 2.8% LAS, 2.6% SAS, 2.8% ethyoxylated alcohol, 0.2% fragrance
C = 6.5% borax, 2.5% LAS, 2.6% SAS, 2.5% ethyoxylated alcohol, 0.4% fragrance While described in terms of the presently preferred embodiments, it is to be understood that such disclosure is not to be interpreted as limiting. Various modifications and alterations will no doubt occur to one skilled in the art after having read the above disclosure. Accordingly, it is intended that the appended claims be interpreted as covering all alterations and modifications as fall within the true spirit and scope of the invention.

I claim:

1. A pourable thickened abrasive cleanser having a plastic rheology and substantially no syneresis comprising, in aqueous solution (a) a particulate abrasive, present in a scouring-effective amount;

(b) a LAS surfactant, having an alkyl group of between about 8 and 18 carbons, and present in an amount of about 0.5 to 5 weight percent;

(c) a thickener, present in an amount of about 3 to 25 percent by weight, including $M_2O\ (SiO_2)_n$ wherein M is an alkali-metal and n is between 0.5 and 5, and a source of borate anion, the borate anion and $M_2O\ (SiO_2)_n$ being present in a ratio of about 1:5 to 4:1; and wherein the cleanser has a composition pH of between about 9.0–11.5, a viscosity of between about 10,000 and 250,000 cP and a yield value of between about 1 to 80 Pa.

2. The cleanser of claim 1 wherein

M is sodium and n is 2.4.

3. The cleanser of claim 1 and further including about 1–10% of a cosurfactant selected from the group consisting of secondary alkane sulfonates, ethoxylated alcohols, ethoxylated alkyl phenols, alkyl ether sulfates, and mixtures thereof.

4. The cleanser of claim 1 wherein the particulate abrasive has a Moh's hardness of about 4 or less, and is present in an amount of about 10 to 50 percent by weight.

5. The cleanser of claim 4 wherein the particulate abrasive is calcite having a size range of about 99% through a 40 mesh screen.

6. A pourable thickened abrasive cleanser having a plastic flowable rheology and substantially no syneresis comprising, in aqueous solution (a) between about 10 and 50 percent of a calcium carbonate abrasive having a particle size range such that about 99% is smaller than 40 mesh;

(b) between about 0.5 and 5 percent of a LAS surfactant having an alkyl chain length of about 8 to 18 carbons;

(c) between about 1 and 5 percent of a cosurfactant;

(d) an electrolyte/buffer to provide a pH of between about 9.0 and 11.5, and to provide a favorable environment in which the alkali-metal silicate and borate anion can combine, with the proviso that the electrolyte/buffer is not an alkali-metal silicate or borate anion;

(e) a thickener, present in an amount of about 3–25 percent by weight, including $M_2O(SiO_2)_n$ wherein M is an alkali-metal and n is between 0.5 and 5, and a source of borate anion, the borate anion and $M_2O(SiO_2)_n$ being present in a ratio of about 1:5 to 4:1; and wherein the cleanser has a viscosity of between about 10,000 and 250,000 cP and a yield value of between about 1 to 80 Pa.

7. The cleanser of claim 6 wherein

M is sodium and n is 2.4, and the borate anion source is borax, sodium metaborate and mixtures thereof.

8. The cleanser of claim 6 wherein the cosurfactant is selected from the group consisting of secondary alkane sulfonates, ethoxylated aliphatic alcohols, ethoxylated alkyl phenols, alkyl ether sulfates, and mixtures thereof.

9. The cleanser of claim 6 wherein the cosurfactant is a mixture of a secondary alkane sulfonate and an ethoxylated aliphatic alcohol.

10. A method for making a hard surface abrasive cleanser characterized by a plastic flowable rheology and substantially no syneresis, the method comprising, in sequence (a) making an aqueous solution of between about 1 and 15 percent of a source of a borate anion, and about 10 and 50 percent of a particulate abrasive;

(b) adding to the solution of (a) about 2 to 10 percent of $M_2O(SiO_2)_n$, wherein M is an alkali-metal and n is between 0.5 and 5, and about 0.5 to 5 percent of a LAS surfactant having an alkyl group of between about 8 and 18 carbons;

(c) mixing the mixture, at a shear rate sufficient to result in vigorous mixing without drawing in air, until completely mixed as evidenced by a uniform appearance; and (d) adding thereto sufficient of an electrolyte/buffer, to yield a composition pH of between about 9.0 and 11.5, and to promote the favorable environment in which the alkali-metal silicate and borate anion can combine, with the proviso that the electrolyte buffer is not alkali-metal silicate or borate anion.

11. The method of claim 10 wherein

M is an alkali-metal and n is 2.4.

12. The method of claim 10 wherein the source of borate anion is borax, sodium metaborate, and mixtures thereof; and the abrasive is calcium carbonate.

13. The method of claim 10 and further including the step of adding about 0–10% of a cosurfactant, selected from the group consisting of secondary alkane sulfonates, ethoxylated aliphatic alcohols, ethoxylated alkyl phenols, alkyl ether sulfates, and mixtures thereof, with the LAS surfactant.

14. In a thickened aqueous abrasive cleanser having an anionic surfactant, a calcium carbonate abrasive, a thickener and an electrolyte/buffer, the improvement comprising (a) the anionic surfactant comprises about 0.5 to 5% of a LAS surfactant with an average alkyl chain length of 8 to 18 carbons;

(b) the thickener comprises an alkali-metal silicate having the formula $M_2O(SiO_2)_n$ wherein M is an alkali-metal and n is between about 0.5 and 5, and a source of borate anion, the thickener being present in an amount of about 3–25 percent by weight of the composition, and sufficient to thicken the composition to a viscosity of between about 10,000 to 250,000 cP and a yield value of between about 1 and 80 Pa, the borate anion and alkali-metal silicate being present in a ratio of between about 1:5 to 4:1; and (c) the electrolyte/buffer is present in an amount sufficient to provide a composition pH of about 9.0–11.5 and to promote the favorable environment in which the alkali-metal silicate and borate anion can combine, and is selected from the group consisting of alkali-metal salts of carbonate, bicarbonates and hydroxides, alkaline earth salts of carbonates and hydroxides, gluconates, succinates, maleates and their alkali-metal salts, aluminates, and mixtures thereof.

15. A method for removing a stain from a hard surface, comprising (a) applying a quantity of a cleanser to a stain to be removed, the cleanser comprising about 1 to 50% of a calcium carbonate abrasive having an average particle size of about 99% smaller than 40 mesh, about 0.5 to 5% of a LAS surfactant having an alkyl chain length of about 8 to 18 carbons, about 3–25 weight percent of a thickener including a $M_2O(SiO_2)_n$, where M is an alkali-metal and n is between 0.5 and 5, the thickener further including a source of a borate anion, present in a ratio to the $M_2O(SiO_2)_n$ of between about 1:5 to 4:1, and sufficient of an electrolyte/buffer to promote the favorable environment in which the alkali-metal silicate and borate anion can combine, the electrolyte/-buffer being selected from the group consisting of alkali-metal salts of carbonates, bicarbonates, and hydroxides, alkaline earth salts of carbonates and hydroxides, gluconates, succinates, maleates and their alkali-metal salts, aluminates, and mixtures thereof, and to provide a composition pH of about 9.0–11.5, and wherein the cleanser has a viscosity of about 10,000 to 250,000 cPs, and a yield value of about 1 to 80 Pa; and (b) removing the cleanser and stain.

16. The cleanser of claim 1 and further including an electrolyte/buffer to promote the favorable environment in which the alkali-metal silicate and borate anion can combine, with the proviso that the electrolyte/buffer is not an alkali-metal silicate or borate anion.

17. The cleanser of claim 16 wherein the electrolyte/buffer is selected from the group consisting of alkali-metal salts of carbonates, bicarbonates, and hydroxides, alkaline earth salts of carbonates and hydroxides, gluconates, succinates, maleates and their alkali-metal salts, aluminates, and mixtures thereof.

18. The cleanser of claim 6 wherein the electrolyte/buffer is selected from the group consisting of alkali-metal salts of carbonates, bicarbonates, and hydroxides, alkaline earth salts of carbonates and hydroxides, gluconates, succinates, maleates and their alkali-metal salts, aluminates, and mixtures thereof.

19. The method of claim 10 wherein the electrolyte/buffer is selected from the group consisting of alkali-metal salts of carbonates, bicarbonates and hydroxides, alkaline earth salts of carbonates and hydroxides, gluconates, succinates, maleates and their alkali-metal salts, aluminates, and mixtures thereof.

* * * * *

UNITED STATES PATENT AND TRADEMARK OFFICE

CERTIFICATE OF CORRECTION

PATENT NO. : 4,788,005

DATED : 11/29/88

INVENTOR(S) : James M. Castro

It is certified that error appears in the above—identified patent and that said Letters Patent is hereby corrected as shown below:

Column 1, line 12, change "guest" to --quest--;

Column 2, line 6, change "thicknened" to --thickened--;
line 63 after "buffer;" insert --and--;

Column 5, line 5 after "system" insert --,--;
line 55, change "derived"; to --desired--;

Column 7, line 2 after "salts of" delete ",";
line 33 change "Moh's" to --Mohs--;

Column 8, line 4 after "cPs," delete ".";
line 7, change "pA" to --Pa--;
line 18, change "eed" to --need--;
line 23, change "ingredients, the" to --ingredients. The--;
line 30, change "witn" to --with--;

Column 9, line 4, after "Calcite" insert --,--;
line 16, change "cP" to --cPs--;

Table 6, under "% Borax", change "14" to --10--;

UNITED STATES PATENT AND TRADEMARK OFFICE

CERTIFICATE OF CORRECTION

PATENT NO. : 4,788,005

DATED : 11/29/88

INVENTOR(S) : James M. Castro

It is certified that error appears in the above—identified patent and that said Letters Patent is hereby corrected as shown below:

Column 10, line 34, change "not" to "no";

Column 11, line 55, change "6" to --8--;
line 34, after "4 to 1;" insert --wherein the amount of said thickener being sufficient to maintain the particulate abrasive in suspension--;

Column 12, line 8, after "4 to 1;" insert --wherein the amount of said thickener being sufficient to maintain the particulate abrasive in suspension--;
line 12, change "7" to --9-- and change "6" to --8--;
line 15, change "8" to --10--- and change "6" to --8--;
line 20, change "9" to --11-- and change "6" to --8--;
line 23, change "10" to --13--;
line 32, after "0.5 and 5," insert --wherein the amount of the $M_2O(SiO_2)_n$ and a borate anion source being sufficient to maintain the particulate abrasive in suspension--;

UNITED STATES PATENT AND TRADEMARK OFFICE

CERTIFICATE OF CORRECTION

PATENT NO. : 4,788,005

DATED : 11/29/88

INVENTOR(S) : James M. Castro

It is certified that error appears in the above—identified patent and that said Letters Patent is hereby corrected as shown below:

Column 12, line 44, after "not" insert --an--;
line 45, change "11" to --14--;
line 47, change "12" to --15--;
line 51, change "13" to --16--;
line 57, change "14" to --18--;
line 66, after "0.5 and 5," insert --wherein the amount of the $M_2O(SiO_2)_n$ and a borate anion source being sufficient to maintain the particulate abrasive in suspension--.

Column 13, line 17, change "15" to --19--;

Column 14, line 8, change "16" to --6--;
line 14, change "17" to --7-- and change "16" to --6--;
line 21, change "18" to --12-- and change "6" to --8--;
line 28, change "19" to --17-- and change "10" to --13--.

Signed and Sealed this

Twenty-sixth Day of February, 1991

*Attest:*

HARRY F. MANBECK, JR.

*Attesting Officer*

*Commissioner of Patents and Trademarks*